United States Patent [19]

Mina

[11] Patent Number: 5,076,239

[45] Date of Patent: Dec. 31, 1991

[54] FUEL INJECTION SYSTEM

[75] Inventor: Theodors I. Mina, Scaldgate, England

[73] Assignee: Perkins Engines Group Limited, England

[21] Appl. No.: 288,642

[22] PCT Filed: Apr. 15, 1988

[86] PCT No.: PCT/GB88/00293

§ 371 Date: Dec. 15, 1988

§ 102(e) Date: Dec. 15, 1988

[87] PCT Pub. No.: WO88/08079

PCT Pub. Date: Oct. 20, 1988

[30] Foreign Application Priority Data

Apr. 15, 1987 [GB] United Kingdom ..... 8709038

[51] Int. Cl.[5] ..... F02M 37/04

[52] U.S. Cl. ..... 123/496; 123/447

[58] Field of Search ..... 123/496, 447, 500, 501, 123/449, 503

[56] References Cited

U.S. PATENT DOCUMENTS

| | | | |
|---|---|---|---|
| 2,810,375 | 10/1957 | Froehlich | 123/447 |
| 3,416,506 | 12/1968 | Steiger | 123/447 |
| 3,810,453 | 5/1974 | Wolfe | 123/447 |
| 4,029,071 | 6/1977 | Saito | 123/447 |
| 4,161,161 | 7/1979 | Bastenhof | 123/447 |
| 4,421,088 | 12/1983 | Seilly | 123/447 |

FOREIGN PATENT DOCUMENTS

| | | | |
|---|---|---|---|
| 888038 | 7/1949 | Fed. Rep. of Germany | 123/496 |
| 1180630 | 2/1970 | United Kingdom | 123/496 |

*Primary Examiner*—Carl Stuart Miller
*Attorney, Agent, or Firm*—Oliff & Berridge

[57] ABSTRACT

Fuel injection equipment for an internal combustion engine is modified by connecting a closed chamber (28) via a permanently open flow restriction (29) either to the working chamber (11) of a fuel pump (1), or to a high pressure fuel supply connection (36) between the output of the working chamber (11) and a fuel injector (39), or to a pressurized fuel supply passage (55) in the injector upstream of an injector valve (48). The volume of the closed chamber (28) and the cross sectional flow area of the restriction (29) are selected to allow a predetermined volume of pressurized fuel to flow into the closed chamber (28) when the equipment is operating, thereby reducing the flow of fuel through the injector valve (48) during the initial period of injection. To reduce combustion noise at and below a predetermined engine speed, the volume of the closed chamber (28) and the cross sectional flow area of the restriction (24) are selected to allow a predetermined volume of fuel to flow into the closed chamber (28) during the ignition delay period at said predetermined speed, said predetermined volume of fuel corresponding to the maximum compressiblity of the fuel in the closed chamber at said predetermined engine speed. A second flow restriction (40) is added in the flow path (41) to the fuel injector (39) downstream of the connection to the closed chamber (28). This second restriction (40) is located adjacent to the connection (29) to the closed chamber (28) and has a cross sectional flow area comparable to the minimum cross sectional flow area of the flow path downstream of the second restriction (40).

37 Claims, 15 Drawing Sheets

FUEL INJECTION SYSTEM

TECHNICAL FIELD

This invention relates to the injection of fuel in an internal combustion engine, and more specifically, to controlling fuel injection so as to reduce the fuel injection rate at the start of fuel injection, especially under low-speed or low-load conditions so as to reduce combustion noise.

It is well known that the combustion noise of a diesel engine can be reduced under low-speed or low-load conditions by reducing the fuel injection rate. This has been achieved by providing a valve that opens to bleed fuel from the working chamber of the pump under low-speed or low-load conditions. For example, British Patent No. 2048373 discloses a fuel injection pump having a solenoid-operated valve that controls connection of the pump working chamber to an accumulator via a flow restrictor. The valve is urged to a closed position by spring means and fuel pressure in the pump working chamber, and is opened by the solenoid when energised. However, there is a tendency for the valve to reciprocate in operation due to the force of the solenoid overcoming the dynamic throttling effect of the fuel flow through the valve. Further, the fuel flow through the valve is dependent upon the lift pressure of the injector valves and upon the temperature of the fuel. Therefore, the valve is subject to wear and is inconsistent in operation. British Patent No. 1261246 discloses a fuel injection pump having a valve that controls connection of the pump working chamber through a restrictor to a closed chamber. The valve is a spool valve or rotary valve that is held either open or closed and is moved between these positions in accordance with engine operating conditions, such as engine speed or load.

U.S. Pat. No. 4,449,504 discloses a fuel injection pump having an accumulator connected to the pump working chamber so that it is responsive to the fuel pressure therein and serves to increase the volume of the working chamber with increasing fuel pressure under low-speed or low-load conditions. The accumulator comprises a piston which is moveable in a bore connected to the pump working chamber and which is backed up by a spring in a spring chamber that is connected via a rotary valve to the pump fuel supply. Under low-speed or low-load conditions, the piston is free to move against the action of the spring, but above a predetermined threshold speed or load, the valve is closed to isolate the spring chamber and thereby substantially lock the piston against movement.

German Patent No. 883038 discloses a fuel injection device in which an accumulator connected with the fuel supply line via a flow restrictor is used to automatically advance the start of fuel injection with increasing engine speed. This patent is totally concerned with events occurring within the fuel supply line, accumulator and orifice prior to the commencement of fuel injection in each cycle of the engine and the flow restrictor is specified as being sufficiently wide so that across the entire speed range of the engine the peak pressure in accumulator remains substantially the same.

British Patent No. 1573981 discloses a fuel injection device in which a very small accumulator is connected with the fuel supply line via a flow restrictor in order to reduce variations in fuel pressure at the end of the fuel injection stage of each cycle of the engine so as to produce a sharp cut-off in injection.

DISCLOSURE OF THE INVENTION

An object of the present invention is to provide an improved method and means of controlling fuel injection, in particular to reduce combustion noise by reducing the fuel injection rate at the start of fuel injection, especially under low-speed conditions.

According to one aspect of the invention, a method of controlling the injection of fuel from a pressurised fuel supply via an injector valve of a fuel injector is characterised in that a closed chamber is connected via a permanently open flow restriction to the pressurised fuel supply, the volume of the closed chamber and the cross-sectional flow area of the restriction being selected to allow a predetermined volume of pressurised fuel to flow into the closed chamber when the engine is operating, thereby reducing the flow of fuel into the combustion chamber during the initial period of injection.

If a predetermined engine speed is selected as that speed at which it is desired to maximise reduction of combustion noise, the volume of the closed chamber and the cross-sectional flow area of the restrictions are selected to allow a predetermined volume of fuel to flow into the closed chamber during the ignition delay period at said predetermined speed, said predetermined volume of fuel corresponding to the maximum compressibility of the fuel in the closed chamber at said predetermined engine speed.

Thus the volume of fuel that flows into the closed chamber increases with decreases speed and fuel pressure form a maximum at said predetermined speed, and therefore has a maximum effect up to this speed in reducing the fuel injection rate from the injector. At higher engine speeds, although the fuel pressure continues to increase, the progressive decrease in the ignition delay period has the dominant effect in limiting the volume of fuel that flows through the restriction into the closed chamber. The shorter ignition delay period and the preselected cross-sectional flow area of the restriction are then insufficient to allow a flow corresponding to the maximum compressibility of the fuel in the closed chamber. The restriction therefore acts to limit the flow of fuel into the closed chamber above said predetermined engine speed, thereby maintaining the fuel injection rate at the required level for high speed engine performance. The closed chamber and restriction can therefore be adapted so as to have a selective effect on the initial fuel injection rate at low engine speeds as compared with high engine speeds, thereby providing simple and durable means that avoids the use of valves or other moving components to open and close the chamber or vary its volume. Accordingly, the volume of the closed chamber is controlled to be sufficiently large, and the cross-sectional flow area of the restriction is controlled to be sufficiently small that, for a given engine fuel delivery volume, a maximum pressure reached in the closed chamber during each engine cycle varies with engine speed, whereby the ratio of fuel flowing into the closed chamber during an entire injection period compared to the total fuel volume delivered to the engine decreases as engine speed increases, thus substantially reducing the flow of fuel into the combustion chamber during an initial period of the injection period at low engine speeds compared to the flow during said initial period at high engine speeds.

The closed chamber and restriction have an additional beneficial effect in producing a return flow of fuel into the pump working chamber at the end of the fuel pressure pulse, thereby boosting the fuel injection rate. Because of this, the engine performance penalty can be reduced or eliminated. In some engines, it may even be possible to select the predetermined engine speed so as to reduce combustion noise over the whole of the engine speed range without an unacceptable effect on engine performance.

According to another aspect of the invention, fuel injection equipment for an internal combustion engine is modified by connecting a closed chamber via a permanently open flow restriction either to the working chamber of a fuel pump, or to a high pressure fuel supply connection between the output of the working chamber and a fuel injector, or to a presurised fuel supply passage in the injector upstream of an injector valve, the volume of the closed chamber and the cross-sectional flow area of the restriction being selected to allow a predetermined volume of pressurised fuel to flow into the closed chamber when the equipment is operating, thereby reducing the flow of fuel through the injector valve during the initial period of injection. Thus, the closed chamber may be incorporated in the fuel pump or the high pressure fuel supply connection or the fuel injector.

In the case of the rotary type fuel pump, with a single pump working chamber, the closed chamber is connected to this pump working chamber via the flow restriction. However, in the case of an in-line type fuel pump having a plurality of pump working chambers each supplying fuel to a respective fuel injector, a separate closed chamber is connected to each working chamber via a respective flow restrictor.

The effect of the closed chamber on fuel injection can be enhanced by the addition of a second flow restriction in the flow path to the fuel injector downstream of the connection to the closed chamber. Preferably, this second restriction is located adjacent to the connection to the closed chamber, and the cross-sectional flow area of the second restriction is comparable with but preferably no smaller than the minimum cross-sectional flow area of the flow path downstream of the second restriction.

In the case where the closed chamber is connected to the high pressure fuel supply connection between the working chamber and the injector, the chamber and flow restriction together with the second flow restriction, if provided, may be formed in a single component that is connected into the supply connection. Alternatively, the second flow restriction may be located on or in the fuel injector, especially where the closed chamber and flow restriction are also located on or in the injector. In one embodiment, both flow restrictions may be formed in an intermediate component that is assembled coaxially with a nozzle portion of the injector housing the injector valve. The restriction may comprise longitudinally extending bores parallel to the injector axis and aligned with the fuel flow passages and the closed chamber, the latter being formed as a longidudinally extending elongate chamber in the intermediate component and/or the nozzle portion of the injector.

DESCRIPTION OF THE DRAWINGS

The invention will now be described by way of example with reference to the accompanying drawings in which.

BEST MODE OF CARRYING OUT THE INVENTION

Figure 1:
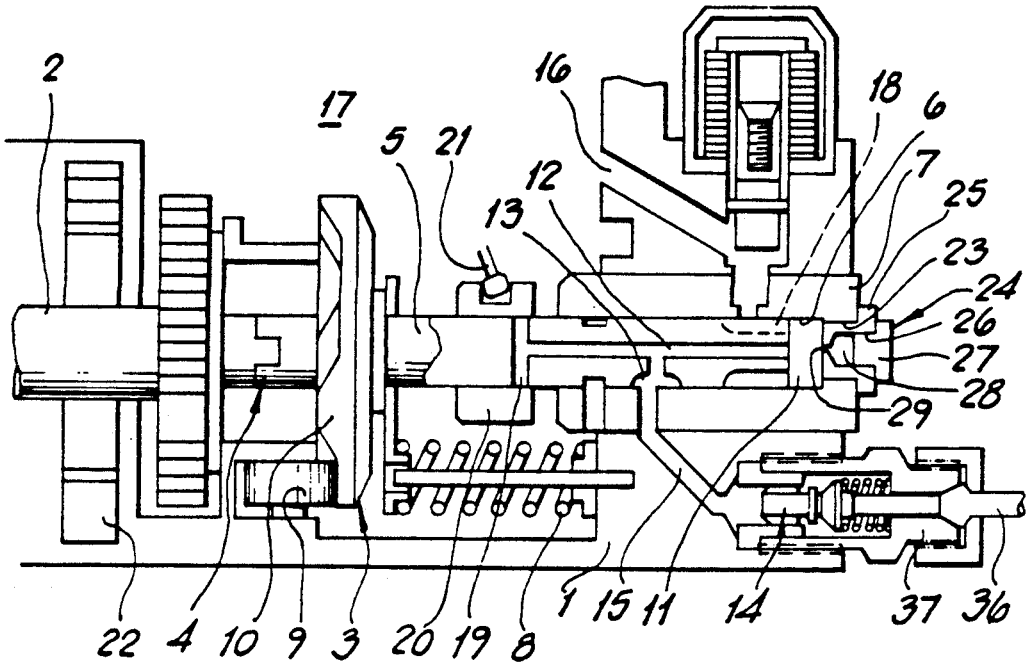
FIG. 1 is a schematic drawing of a rotary fuel injection pump incorporating the invention.

The illustrated rotary fuel injection pump comprises a housing 1, a drive shaft 2 that is journalled in the housing and is driven by a diesel engine on which the pump is installed, a face cam 3 that is connected coaxially to the drive shaft 2 via a coupling 4 that allows relative axial movement of the drive shaft and face cam, and a plunger 5 that is coaxially secured to the cam 3 and is rotatably and slidably received in a cylindrical bore 6 of a pump cylinder 7. A spring 8 acts on the cam to urge it into engagement with a fixed roller 9 so that the cam and plunger are reciprocated through cooperation of the roller 9 with cam lobes 10 on the cam as the latter is rotated by the drive shaft 2.

Each stroke of the plunger 5 serves to pump fuel from the working chamber 11 in the bore 6 at the end of the plunger, the fuel being delivered through a central passage 12 and a distribution duct 13 in the side wall of the plunger to a respective delivery valve 14 that is connected via a high pressure pipe to an associated fuel injector in the engine.

In the case of a pump for a four cylinder engine, the face cam has four lobes 10, and four delivery valves 14 are provided in the pump housing 1 and communicate with the bore via respective distribution passages 15 so that fuel is delivered to each in turn on successive strokes of the plunger 5.

Fuel is supplied to the working chamber 11 through a supply passage 16 in the pump housing 1 that is connected to a fuel supply chamber 17 within the housing. Fuel intake grooves 18 are provided in the side wall of the plunger so that each in turn communicates with the supply passage 16 on successive suction strokes of the plunger, there being an equal number of intake grooves 18 as engine cyinders. Thus, in the case of a pump for a four cylinder engine, the plunger reciprocates once every quarter revolution and serves to draw in fuel through a respective intake groove 18 on the suction stroke, and then serves to deliver fuel through the central passage 12 and distribution duct 13 to a respective delivery valve 14 on the delivery stroke. The end of fuel delivery is determined by opening of a spill port 19 in the plunger that is connected to the central passage 12. A control sleeve 20 is a slide fit on the plunger and cooperates with the spill port 19, and a control lever 21 connected to the sleeve 20 pivots under the control of a centrifugal governor (not shown) so as to allow opening of the spill port 19 at earlier times in the pump cycle thereby reducing the quantity of fuel injected.

A vane-type feed pump 22 is mounted on the drive shaft 2 and serves to feed fuel into the supply chamber 17 from an external fuel tank. The pressure within the chamber 17, termed the transfer pressure, increases with engine speed controlled by a pressure-regulating valve (not shown).

The outer end of the pump cylinder 7 is formed with a threaded coaxial hole 23 in which is fitted an assembly 24 comprising an outer plug 25 that is threaded in the hole 23 and has a coaxial blind bore 26 closed by an inner plug 27 so as to define a closed chamber 28 therebetween that is connected to the pump working chamber 11 via a restriction comprising a small coaxial aperture 29.

Figure 2:
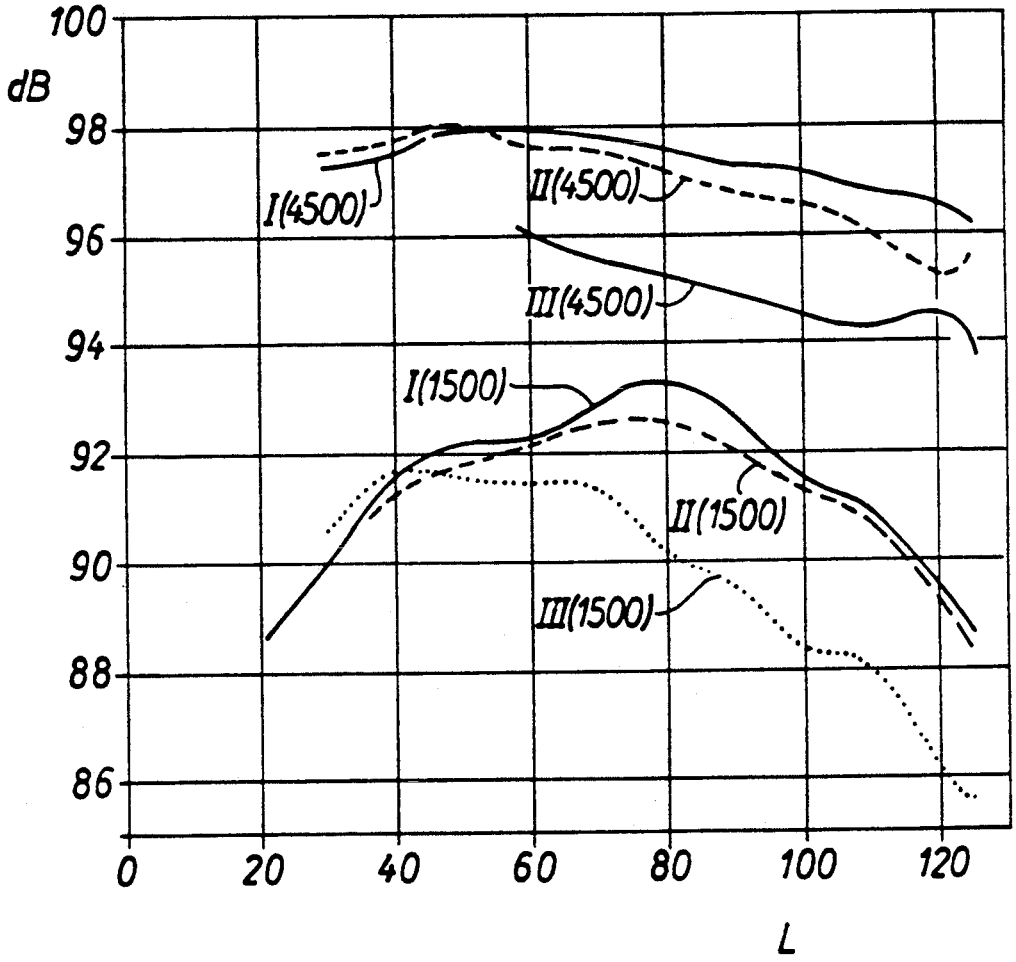
FIG. 2 is a graph showing curves of engine combustion noise (dB) against load (L) at different speeds for closed chambers with different volumes.

The effect of the closed chamber 28 on combustion noise is illustrated in FIG. 2 by comparison of noise levels with and without the chamber 28 and with chambers having different volumes.

A diesel engine fitted with a fuel injection pump as illustrated in FIG. 1 was put through a series of constant speed-variable load tests, and combustion noise (dB) was plotted against load (L) at each speed of 1500 r.p.m. and 4500 r.p.m. One such set of tests was conducted with the pump having a conventional plug in place of the plug 25 so that there was no chamber 28; the measured noise levels are shown by the curves I in FIG. 2. A second set of tests was conducted with the illustrated aperture 29 in the form of a drilled hole of 7 m.m. diameter connected to a chamber 28 of 1 c.c. volume; the measured noise levels are shown by the curves II in FIG. 2. A third set of tests was conducted with the illustrated pump having a chamber 28 of 2 c.c. volume and with the same aperture of 7 m.m. diameter; the measured noise levels are shown by the curves III in FIG. 2.

The curves in FIG. 2 demonstrate that the chamber 28 does reduce engine noise, and furthermore, they demonstrate that the larger volume of 2 c.c. (curves III) gives a greater noise reduction than 1 c.c. (curves II) The 2 c.c. volume was therefore adopted as the optimum volume in determining the affect of different cross-sectional areas for the aperture 29 connecting the chamber 28 to the pump working chamber 11.

In order that the aperture 29 should have a progressive effect in limiting the fuel flow through it with increasing engine speed, the cross-sectional area of the aperture 29 was made much smaller than the 7 m.m. diameter hole used in the aforesaid tests. Thus, holes of 0.8 m.m. diameter and 0.4 m.m. diameter were used for aperture 29, and the same constant speed - variable load, noise level tests were conducted. The results are illustrated in FIG. 3, where curves I are the results using the 0.8 m.m. diameter hole and curves II are the results using the 0.4 m.m. diameter hole.

Figure 3:
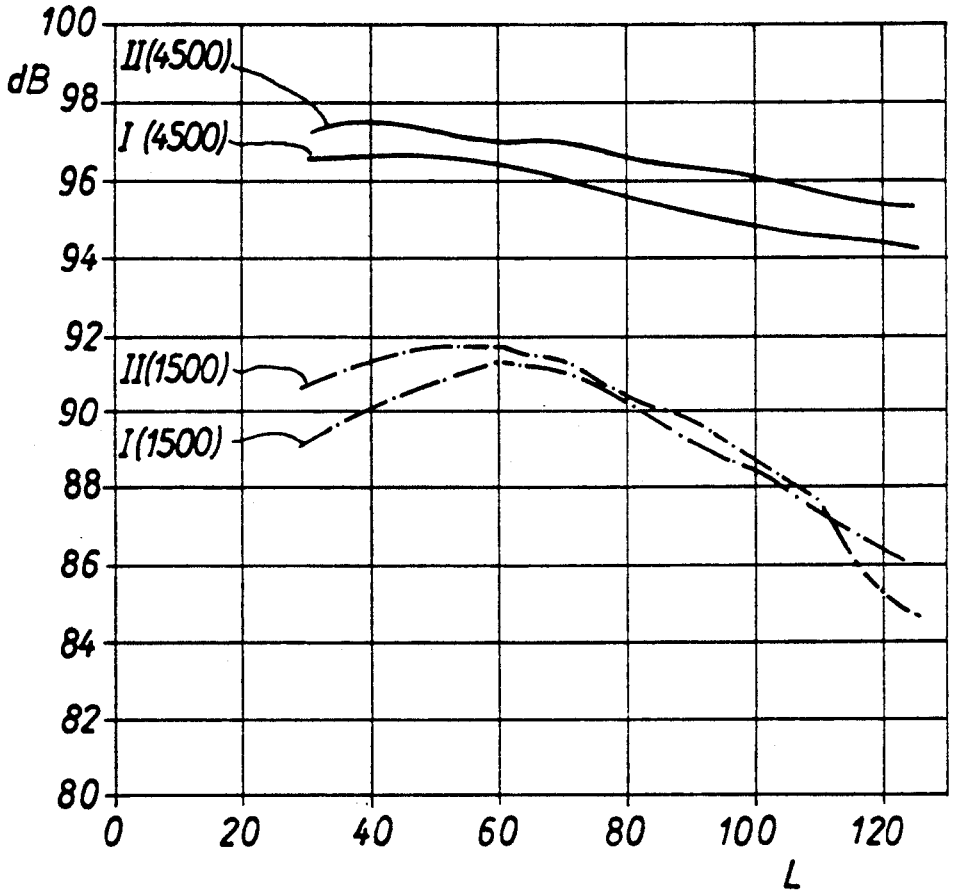
FIG. 3 is a similar graph to that of FIG. 2 for different size apertures opening into the closed chamber.

FIG. 3 demonstrates that both 0.8 m.m. and 0.4 m.m. diameter holes serve to reduce engine noise levels at the low speed 1500 r.p.m., compared with the noise levels for the conventional pump with no chamber 28 shown by the curve I in FIG. 2. The noise levels for the 0.8 m.m. and 0.4 m.m. diameter holes at low speed are both comparable with the reduced noise levels for the 7 m.m. diameter hole/2 c.c. chamber shown by curves III in FIG. 2.

At the higher engine speed 4500 r.p.m., the noise levels of the 0.8 m.m. and 0.4 m.m. diameter holes are different. That of the 0.8 m.m. hole (curve I) is still comparable with the reduced noise levels of the 7 m.m. hole /2 c.c. chamber shown by curve III in FIG. 2, but the noise levels of the 0.4 m.m. hole are greater, although still being less than the noise levels for the conventional pump with no chamber 28, shown by the curves I in FIG. 2.

It would seem therefore that at engine speeds up to 4500 r.p.m., the 0.8 m.m. hole acts as an open hole that allows a substantially unrestricted flow of fuel through it within the ignition delay period at the start of the fuel injection pulse thereby allowing the chamber 28 to be effective as an accumulator that reduces the initial fuel injection rate and thereby reduces engine noise.

The 0.4 m.m. hole acts similarly as an open hole at the lower engine speed of 1500 r.p.m., but not at the higher engine speed when it appears to restrict the fuel flow into the chamber 28 during the ignition delay period. Thus the 0.4 m.m. hole has a speed dependent effect in connecting the pump working chamber 11 to the closed chamber 28, this connection being fully open at lower engine speeds but effectively becoming progressively closed or restricted with increasing engine speed.

The same tests were conducted using a 0.6 m.m. diameter hole for aperture 29, and the noise level results obtained were substantially the same as for the 0.4 m.m.

hole indicating that this also acts in a speed dependent manner in connecting the pump working chamber 11 to the closed chamber 28.

In order to assess the affect of the different diameter holes 29 on engine performance, a series of engine performance tests were conducted for each, measuring power (KW), torque (KN), specific fuel consumption (sfc) and smoke (S) at different engine speeds, the sfc and smoke tests being conducted at full engine load. The results are shown in FIGS. 4 to 7.

Figure 4:
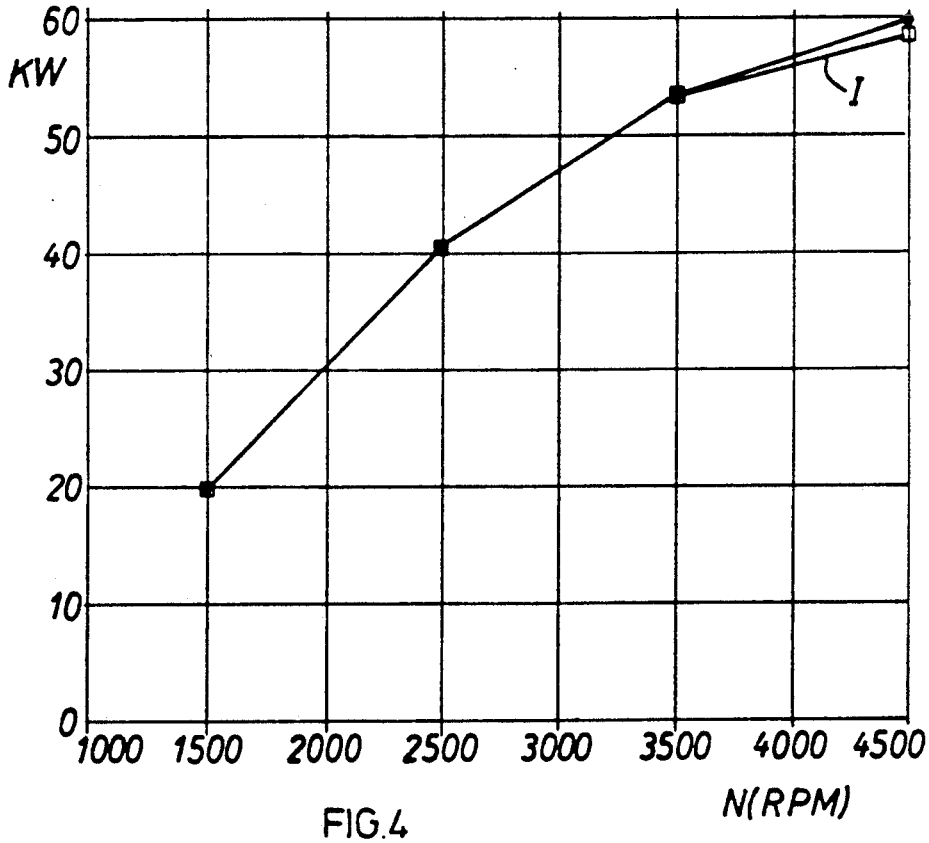
FIG. 4 is a graph of power performance (KW) curves for the engine with different size apertures opening into the closed chamber.

FIG. 4 shows the power curves for the same engine with the different size holes of 0.8 m.m, 0.6 m.m. and 0.4 m.m. diameter, and with a conventional plug 25 having no chamber 28. These curves demonstrate that the power curves are substantially the same in all cases except for the 0.8 m.m. diameter hole which causes a fall off in power at speeds above 3500 r.p.m. as shown by the curve I in FIG. 4.

Figure 5:
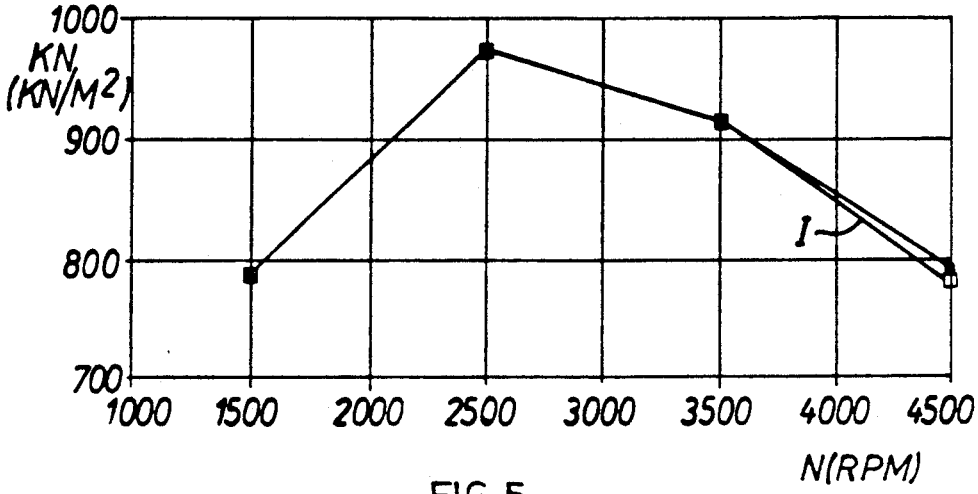
FIG. 5 is a graph of torque performance (KN) curves for the engine with the different size apertures of FIG. 4.

FIG. 5 shows the torque curves for the same engine with the different size holes and no chamber 28, and these also demostrate that the performance is the same in all cases except for the 0.8 m.m. diameter hole which causes a fall off in torque at speeds above 3500 r.p.m., shown by the curve I in FIG. 5.

Figure 6:
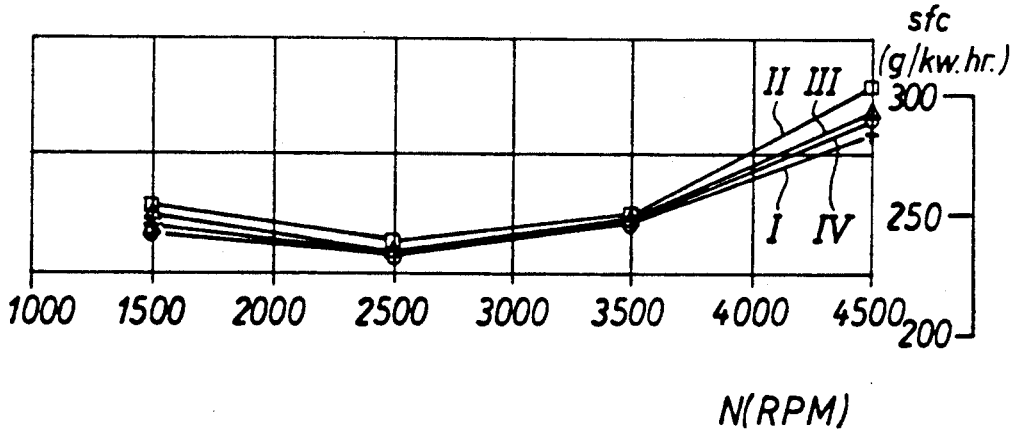
FIG. 6 is a graph of specific fuel consumption (sfc) curves for the engine with the different size apertures of FIG. 4.

FIG. 6 shows the specific fuel consumption for the same engine with the different size holes and no chamber 28, the performance curves being identified as follows: I for no chamber, II for the 0.8 m.m. hole, III for the 0.6 m.m. hole and IV for the 0.4 m.m. hole. These curves indicate that no chamber (curve I) gives the best sfc and that the largest diameter hole of 0.8 m.m. diameter (curve II) gives the worst sfc results, especially at higher speeds. The 0.6 m.m. and 0.4 m.m. diameter holes give intermediate sfc results.

Figure 7:
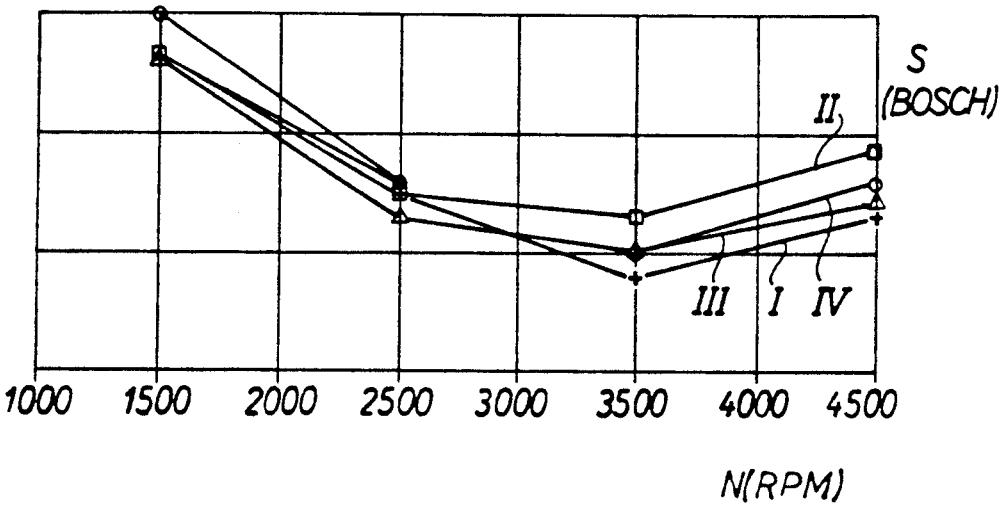
FIG. 7 is a graph of smoke emission (S) curves for the engine with the different size apertures of FIG. 4.

FIG. 7 shows the smoke emission (S) curves for the same engine with the different size holes and no chamber 28, the performance curves being identified as in FIG. 6. These curves indicate that overall, no chamber (curve I) gives the lowest smoke and the 0.8 m.m. hole (curve II) gives the worst smoke emissions, especially at higher speeds.

The 0.4 m.m. hole (curve IV) gives the worst smoke emissions at low speeds whilst the 0.6 m.m. hole (curve III) gives the lowest smoke emissions at low speeds and low emissions comparable to no chamber (curve I) at higher speeds.

The performance results therefore confirm that a larger diameter hole 29 (e.g. 0.8 m.m. diameter) connecting the pump working chamber 11 to the closed chamber 28 will produce a deterioration in performance at higher engine speeds, but that this can be avoided by providing a smaller diameter hole that effectively closes or restricts connection to the chamber 28 at higher speeds. In this example, smaller holes of 0.4 m.m. and 0.6 m.m. diameter give better engine performance, with the 0.6 m.m. hole giving lower smoke emissions. Thus, the aperture 29 can be optimised as a 0.6 m.m. diameter hole, that produces reduced engine noise at lower engine speeds without producing an unacceptable deterioration of engine performance at higher engine speeds.

Figure 8:
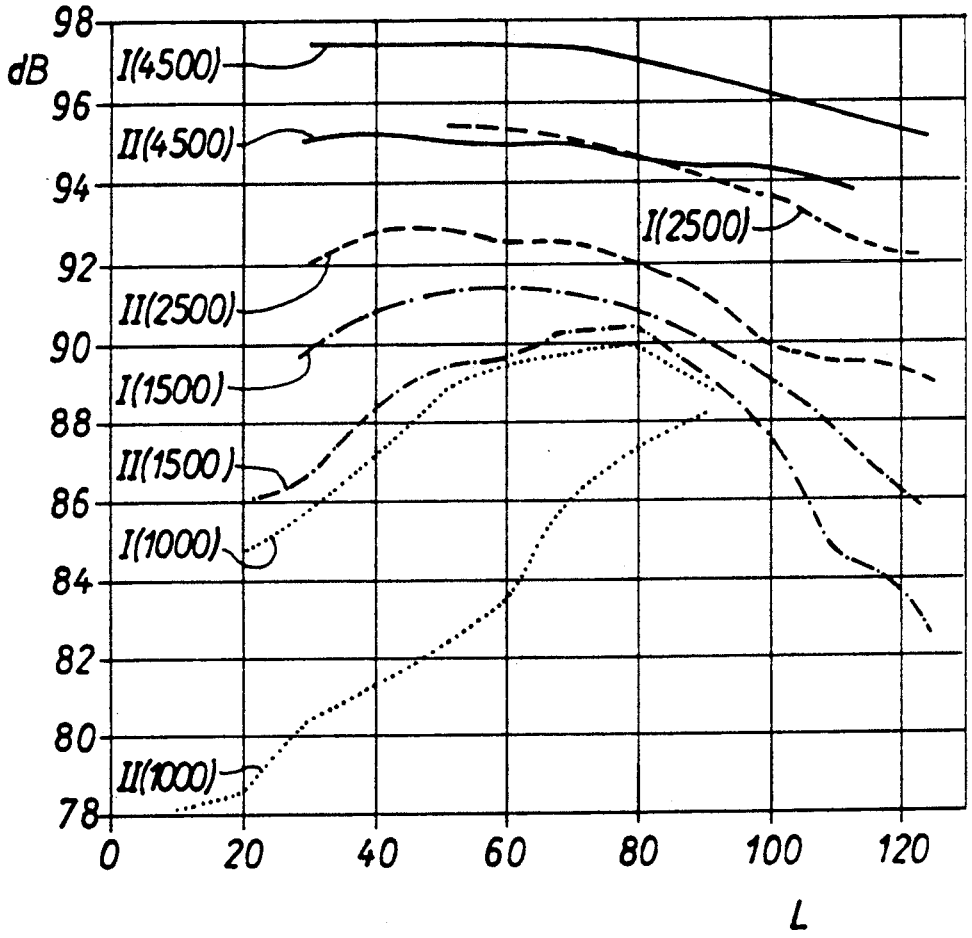
FIG. 8 is a graph showing curves of engine combustion noise (dB) against load (L) at different speeds for different injection timings.

All of the tests described above were conducted with the engine injection timing set at 12 degrees BTDC at an engine speed of 4500 r.p.m. However, the noise levels of the engine can be improved by retarding the injection timing. This is illustrated in FIG. 8 which shows noise—load curves at different speeds and injection timings for an engine with a 2 c.c. chamber 28 and an aperture 29 of 0.6 m.m. diameter. Curves I relate to an injection timing of 12 degrees BTDC and curves II relate to an injection timing of 5 degrees BTDC. The engine speeds for testing were 1000 r.p.m., 1500 r.p.m., 2500 r.p.m., and 4500 r.p.m. These curves show that the noise is reduced at all speeds, but that the greatest reduction is produced at low speed, low load conditions such as at the lowest measured speed of 1000 r.p.m. This is significant because it is at low speed, low load conditions that engine noise is most noticeable to the driver of a diesel engine powered vehicle.

Figure 9:
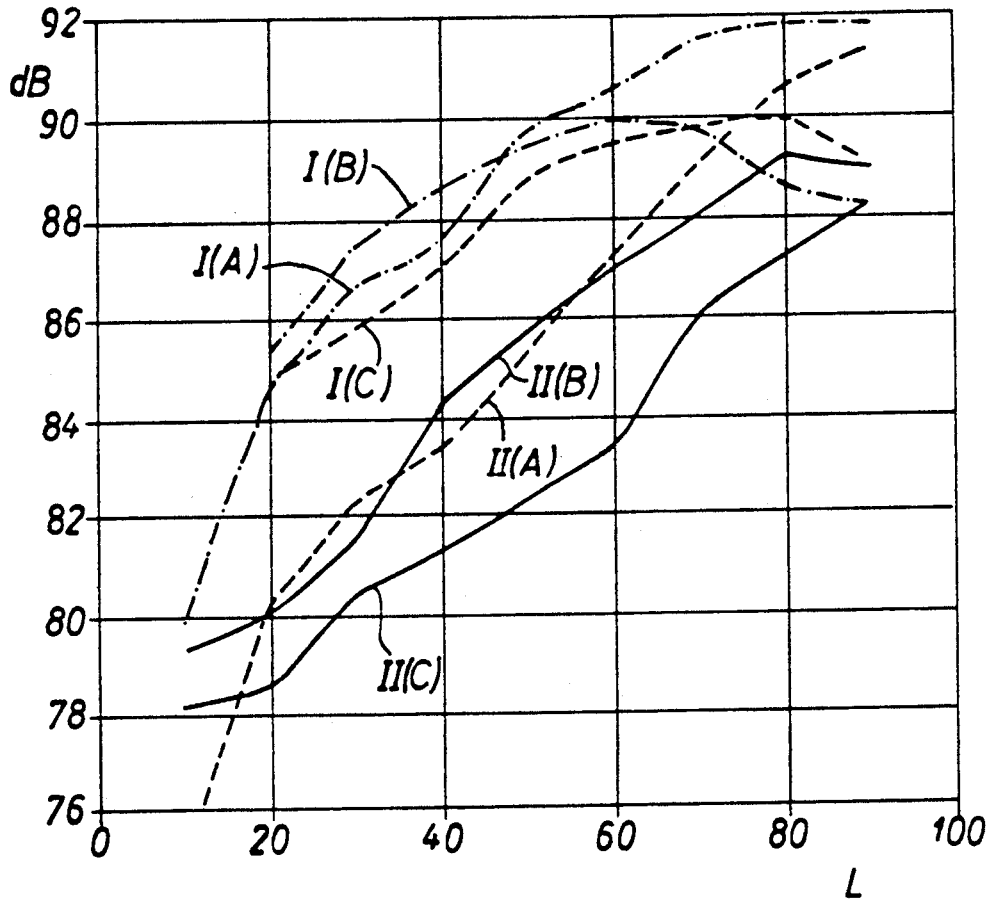
FIG. 9 is a graph showing curves of engine combustion noise (dB) against Load (L) at 1000 r.p.m. for different chambers and apertures at different injection timings.

In order to further demonstrate the reduced noise levels at retarded injection timings, a series of comparative tests were conducted with the same engine fitted with a fuel injection pump having in one case (A), no chamber 28, in a second case (B) having a chamber 28 of 2 c.c. volume connected by a 7 m.m. diameter hole to the pump working chamber 11, and in a third case (C) having a chamber 28 of 2 c.c. volume connected by a 0.6 m.m. diameter hole to the pump working chamber 11. Noise measurements were made for varying loads at a speed of 1000 r.p.m. and an injection timing of 12 degrees BTDC and 5 degrees BTDC. The results are shown in FIG. 9. Curves I relate to the injection timing of 12 degrees BTDC and curves II relate to the injection timing of 5 degrees BTDC. These curves show that case (C) with the 2 c.c. volume and 0.6 m.m. diameter hole produces the lowest noise levels, and that this is most pronounced at the retarded timing of 5 degrees BTDC represented by the curve II (C). At this retarded timing, the noise at high load is even lower than for case (B) with the 2 c.c. volume and 7 m.m. diameter hole represented by curve I(B).

Figure 10:
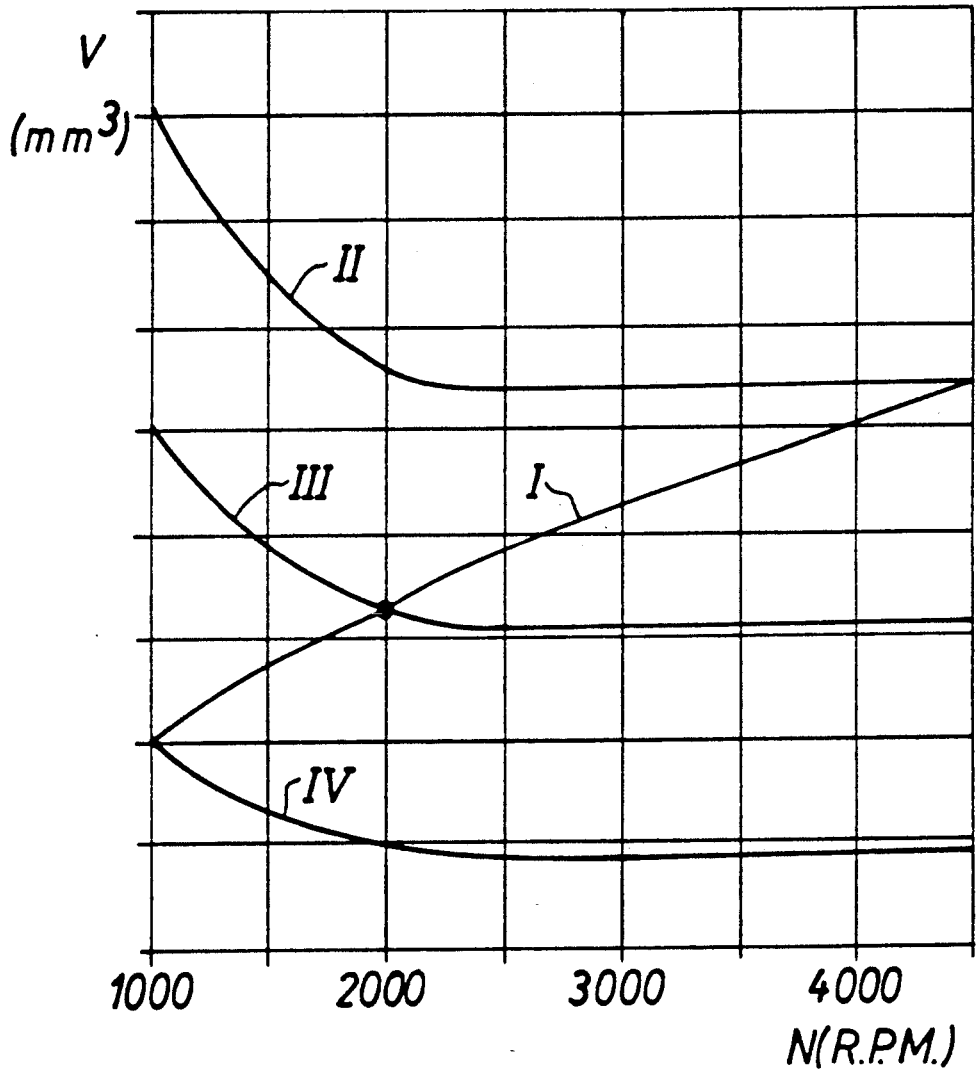
FIG. 10 shows graphs of fuel flow (V) during the ignition delay time (T) against engine speed (N)

The curves shown in FIG. 10 are based on a theoretical analysis of the flow of fuel V through the aperture 29 into the closed chamber 28 of 2 c.c. volume. Curve I represents the maximum volume of fuel that can flow into the closed chamber 28 as a result of the compressibility of the fuel at different fuel pressures. Fuel pressure increases with engine speed and thus the maximum flow volume increases with increasing engine speed as shown.

The curves II, III and IV represent the volume of fuel that flows through the aperture 29 into the closed chamber 28 during the ignition delay period, assuming that the closed chamber is large enough not to be filled by the flow into it. Each curve represents a different diameter aperture 29 of 0.92 m.m. for curve II, 0.76 m.m. for curve III and 0.57 m.m. for curve IV, and shows how the flow decreases with increasing engine speed as the ignition delay period decreases.

Assuming now that the aperture 29 has a diameter of 0.76 m.m. and the closed chamber 28 a volume of 2 c.c., the flow of fuel into the chamber 28 will increase with engine speed up to the speed 2000 r.p.m. along the curve I in FIG. 10. At this speed, the fuel pressure and ignition delay period are such that the flow into the chamber 28 during the ignition delay period is equal to the maximum flow corresponding to the compressibility of the fuel in the closed chamber at this fuel pressure. At speeds above 2000 r.p.m., the continuing decrease in the ignition delay time has the predominant effect on the flow into the closed chamber, and causes the flow during the ignition delay time to decrease to a substantially constant level, shown by curve III in FIG. 10. Thus, the aperture and closed chamber have a maximum effect in reducing the fuel injection rate below and up to 2000 r.p.m., but have less effect at speeds above 2000 r.p.m. This reduced effect above 2000 r.p.m. is especially noticeable as compared with the potential effect of the closed chamber 28 having a much larger aperture 29, shown by the curve I in FIG. 10 above its intersection with curve III. It can be seen that the curves I and III diverge continuously beyond the intersection.

Figure 11:
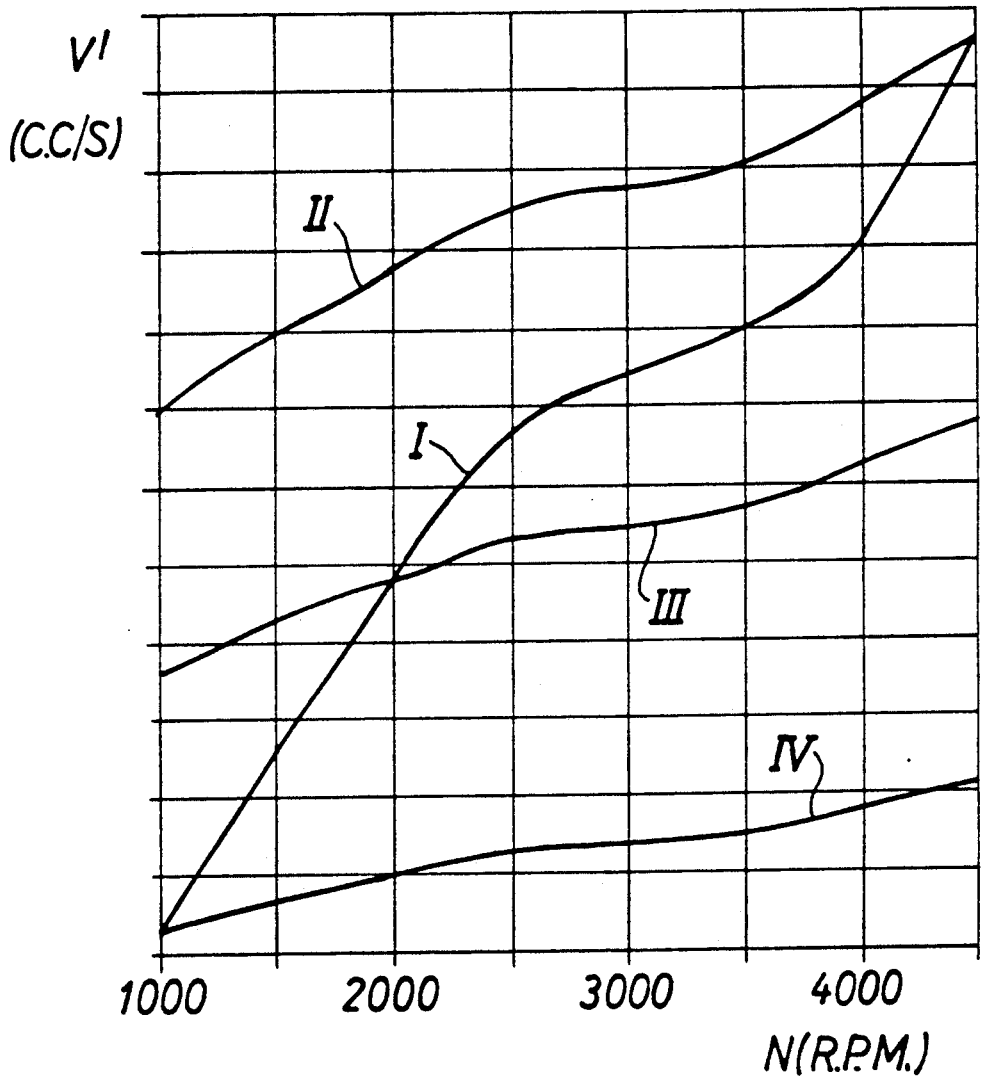
FIG. 11 shows graphs of the rate of flow (V') during the ignition delay time (T) against engine speed (N)

This same point is illustrated in FIG. 11, which shows the flow rates V' corresponding to the flow volumes of curves I, II, III and IV in FIG. 10. Curve III demonstrates how the actual flow rate through the 0.76 m.m. diameter aperture 29 continues to increase beyond 2000 r.p.m., but that the maximum flow rate represented by the curve I is greater and increases at a higher rate.

The curve IV in FIG. 10 shows how the flow volume through an aperture of 0.57 m.m. diameter decreases at speeds above 1000 r.p.m. At 1000 r.p.m., the fuel pressure and ignition delay period are such that the volume of fuel that flows into the closed chamber during the ignition delay period is equal to the maximum volume corresponding to the compressibility of the fuel in the closed chamber at this pressure.

The curve II in FIG. 10 shows how an aperture of 0.92 m.m. diameter is so large that it is only above the highest speed of 4500 r.p.m. that the flow during the ignition delay period is less than the maximum volume corresponding to the compressibility of the fuel in the closed chamber 28.

It will be appreciated from FIG. 10 that curve I determines the maximum required flow volume dV into the closed chamber 28 of 2 c.c. volume at any selected engine speed N, and that the appropriate diameter aperture 29 can then be calculated to match this maximum required flow volume dV during the ignition delay period T at the selected engine speed N and fuel pressure P.

The relationship between the cross-sectional flow area A of the aperture 29 and the above identified parameters is as follows:

$$A = F \cdot \frac{dv \cdot N}{T\sqrt{P}}$$

The fuel pressure P is taken as the maximum pressure. The factor F can be readily derived.

The 2 c.c. volume of the closed chamber 28 has been optimised by experiment above. As a guide, it is clear that the closed chamber 28 has a maximum volume at which the flow of fuel into it corresponds to the compressed volume of the fuel in the pump working chamber 11 so that there is no flow of fuel to the injector. For example, this maximum volume might be about 7 c.c. so the volume of the closed chamber 28 can be readily optimised within this limited range 0 to 7 c.c.

Another approach that can be adopted in optimising the volume V of the closed chamber 28 and the flow area A of the aperture 29, is to consider the volume of fuel Vn injected by the injector and select a corresponding proportion of that fuel that it is desired to remove by flow into the closed chamber during the ignition delay period at the required speed. The flow area A of the aperture 29 can be calculated using the fact that the ratio of the flow area A and the flow area An of the injector nozzle spray holes is proportional to the selected ratio of fuel flow through these areas as follows:

$$\frac{A}{An} = \frac{dV}{Vn}.$$

Once the area A is calculated, the flow volume dV can then be calculated using:

$$dv = \frac{1}{F} \cdot \frac{A \cdot T \cdot \sqrt{P}}{N}$$

Once dV is calculated, the volume V can be calculated from the compressibility of the fuel and the maximum fuel pressure P as follows:

$$V = dV \cdot \frac{K}{P}$$

where K is the modulus of elasticity of the fuel.

If the selected flow dV into the closed chamber is found to have an unacceptable adverse effect on the engine performance at high speeds, then a lower value of dV can be selected and the corresponding lower values of volume V and flow area A used.

Any adverse effect on engine performance tends to be counteracted by a return flow of fuel from the closed chamber 28 into the pump working chamber 11 as the plunger 5 slows towards the end of its stroke. The pressure in the working chamber 11 is therefore maintained longer and the rate of injection at the injector is boosted. The return flow through the aperture 29 will take place over a finite period during which the injection rate is continually boosted. Even an aperture 29 with a large diameter such as the 0.92 m.m. represented by curve II in FIGS. 10 and 11 can give acceptable engine performance at high speeds as the larger quantity of compressed fuel in the chamber 28 flows back into the working chamber and to the injector.

Furthermore, once the pump working chamber 11 is connected to the fuel supply chamber 11 via the spill port 16, the return flow from the closed chamber 28 tends to counter any cavitation problems that might arise.

Figure 12:
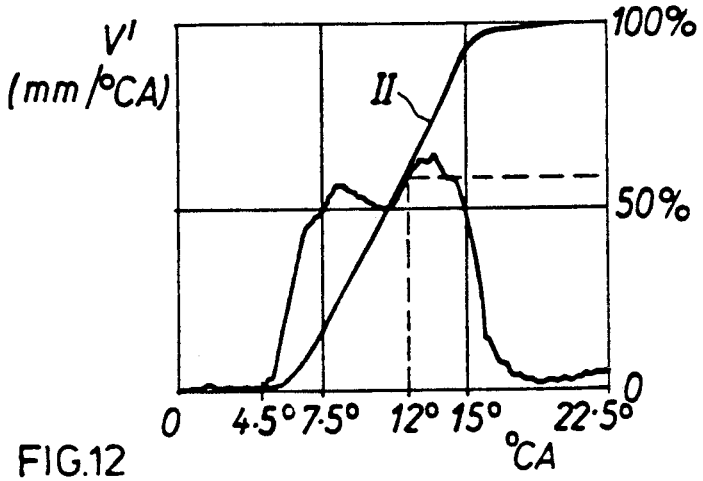
FIG. 12 shows graphs of the rate of fuel flow (V') and accumulative percentage fuel flow.

Another way of analysising the effect of the closed chamber 28 and aperture 29 is to consider the rate of flow of fuel to the injector. Considering an engine and fuel pump without a closed chamber 28, FIG. 12 shows a curve I of the rate of flow of fuel V' to an injector against degrees of rotation of the engine crankshaft at 1000 r.p.m. Curve II represents the accumulative fuel flow to the injector as a percentage of total flow during the injection period, the total being 57 cubic m.m. at 1000 r.p.m. Curve I shows that injection commences at a crank angle of about 4.5 degrees and, allowing an ignition delay period of 7.5 degrees, curve II shows that when ignition commences at about 12 degrees crank angle well over 50 percent of the fuel has been injected.

Figure 13:
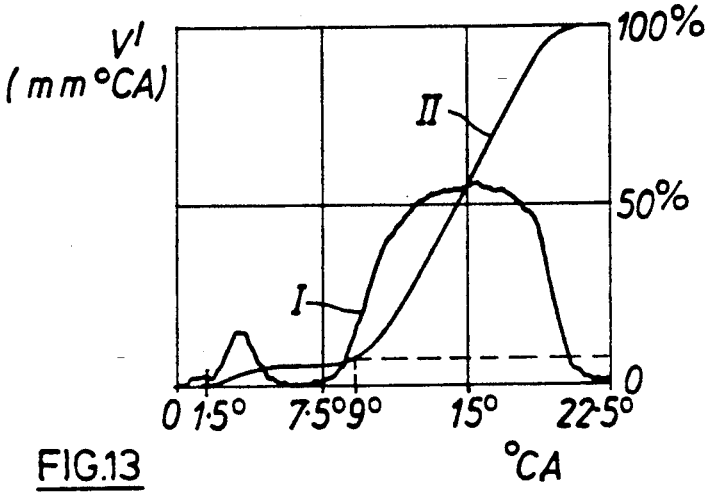
FIG. 13 shows graphs similar to those of FIG. 12 for an engine and fuel pump according to FIG. 1.

FIG. 13 shows similar curves I and II for fuel flow V' and accumulative percentage fuel flow for the same engine and fuel pump as in FIG. 12 but with the addition of a closed chamber 28 having a volume of 3.35 c.c. and an aperture 29 of 0.85 m.m. diameter connecting it to the pump working chamber. Curve I shows that the injection commences at about 1.5 degrees crank angle and, allowing an ignition delay period of 7.5 degrees, curve II shows when ignition commences at about 9 degrees crank angle about 8 percent of the fuel has been injected. Thus, compared with the pump with no closed chamber 28, represented in FIG. 12, the quantity of fuel injected before ignition commences is much less. In fact, the fuel flow drops to zero after an initial injection of fuel, in the manner of two stage or pilot injection. However, after this initial injection, the rate of injection varies in a similar manner to that of the pump with no closed chamber, the general outline of the curves I in FIGS. 12 and 13 being similar beyond 4.5 degrees crank angle in FIG. 12 and 7 degrees crank angle in FIG. 13.

Figure 14:
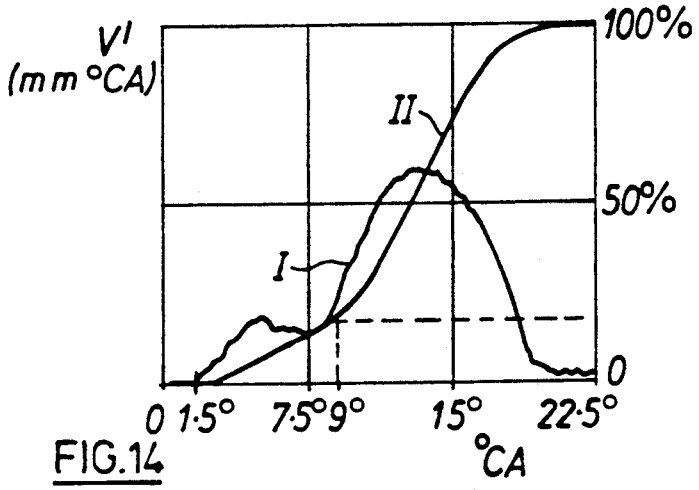
FIG. 14 shows graphs similar to those of FIG. 13 for an engine and fuel pump according to FIG. 1 but with a different size flow restriction.

FIG. 14 show similar curves I and II for fuel flow V' and accumulative percentage fuel flow for the same engine and fuel pump as in FIG. 13, but with a closed chamber 28 of volume 3.35 c.c. and an aperture 29 of 0.4 m.m. diameter. Curve I shows the injection commencing at 1.5 degrees crank angle and ignition commencing at 9 degrees crank angle, as in FIG. 13, but curve II show's that about 18 percent of the fuel has been injected before ignition commences. The closed chamber 28 with an aperture 29 of 0.4 m.m. diameter has therefore taken a smaller flow of fuel during the initial injection period compared with the chamber 28 having the larger diameter aperture 29 of 0.85 m.m., represented 13.

It will be appreciated that the invention reduces combustion noise by reducing the initial fuel injection rate and thus the premixed quantity of fuel. The maximum combustion temperatures are therefore also reduced, which in turn reduces NOx emissions.

Figure 15:
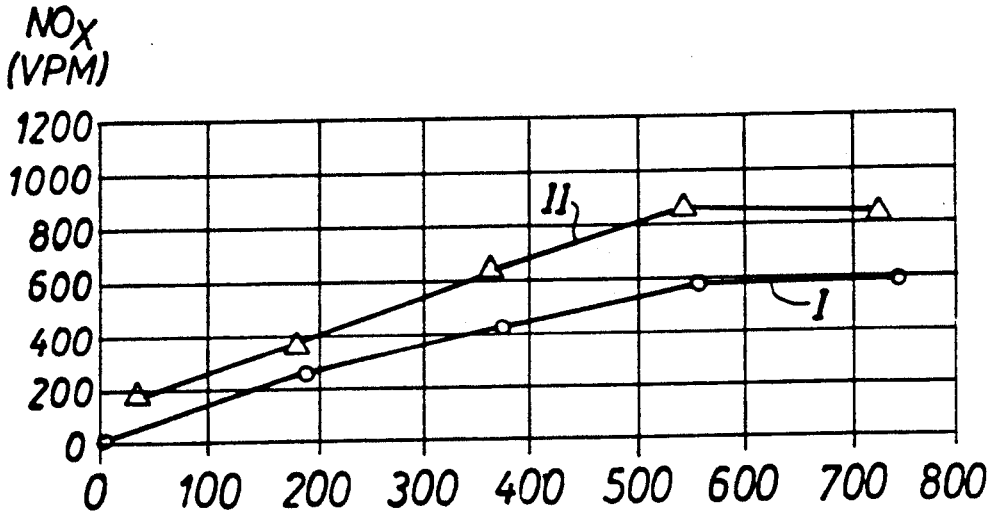
FIG. 15 shows NOx emissions for the engine and pump fitted with a 2 c.c. chamber and 0.4 m.m. diameter flow restriction.
Figure 16:
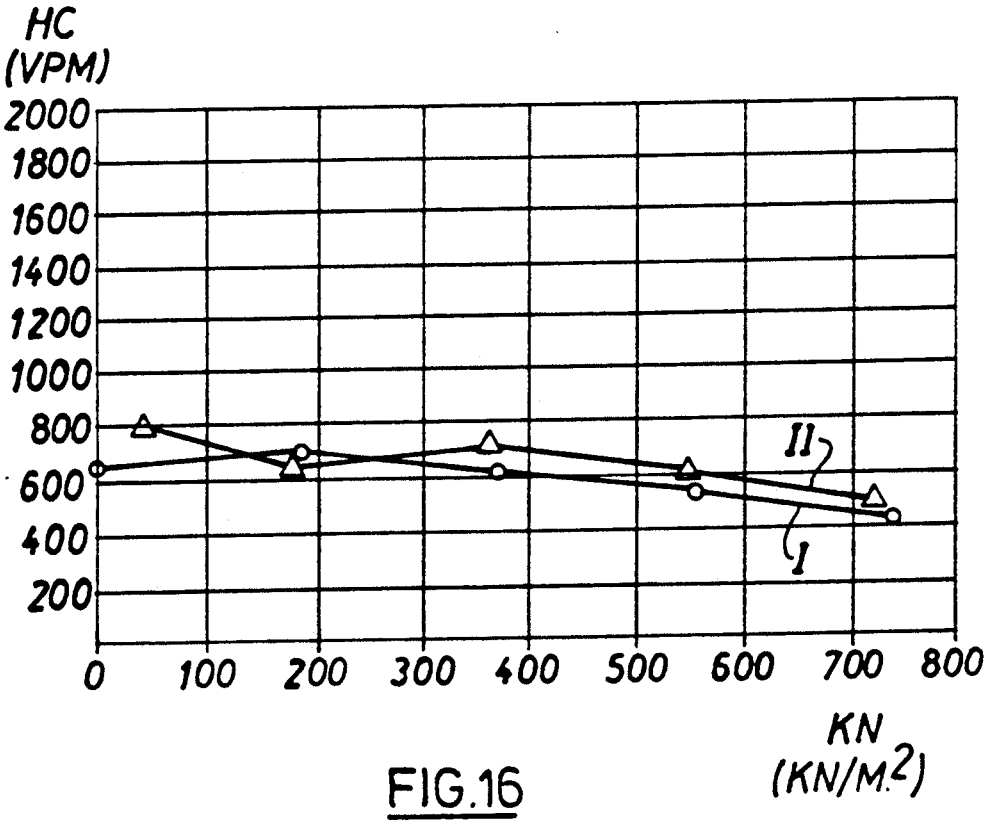
FIG. 16 shows hydrocarbon (HC) emissions for the same engine as in FIG. 15.

This is demonstrated in a series of constant speed variable load tests using the same engine and fuel pump as in the tests of FIGS. 4 to 7, the fuel pump having a chamber 28 of 2 c.c. volume and an aperture 29 do 0.4 m.m. diameter. NOx emissions and hydrocarbon emissions (HC) were measured at a speed of 2000 r.p.m. and compared with emissions measured without the chamber 28. The results are plotted in FIG. 15 for NOx emissions and FIG. 16 for HC emissions, and each shows that the emissions with the chamber 28, represented by curve I are reduced over all or most of the torque range (KN) compared with those without the chamber, represented by curve II.

As well as reducing engine combustion noise, the invention reduces the operating noise of the fuel pump because the closed chamber acts as an accumulator or spring which reduces the impact exerted on the fuel pumping element by its actuator.

The redistribution of fuel caused by the closed chamber 28, involving a reduction in fuel injected during the ignition delay period and a corresponding increase at the end of the injection period, can have a further beneficial effect in reducing the specific fuel consumption, especially at the engine speed for which the closed chamber and restriction are designed. This improvment results from a number of effects including more even and efficient combustion, and a proportionate increase in the fuel injected nearer top-dead-centre.

At retarded injection timings, the ignition delay period is reduced and this has a proportionately greater effect on the amount of fuel injected during the ignition delay period as compared with the standard system without a closed chamber 28. This effect is caused because the rate of flow of fuel into the closed chamber decreases as the chamber is filled towards the end of the ignition delay period and thus the rate of fuel injected increases progressively towards the end of the ignition delay period. Reducing the ignition delay period therefore reduces the time for this higher rate of injected fuel flow, therefore reducing the total amount of fuel injected during the ignition delay period to a greater extent than would be the case in the standard system when the injected fuel flow is more evenly distributed during the ignition delay period. Combustion noise is therefore reduced and this effect is additional to the normal noise reduction obtained when retarding injection timing.

Figure 18:
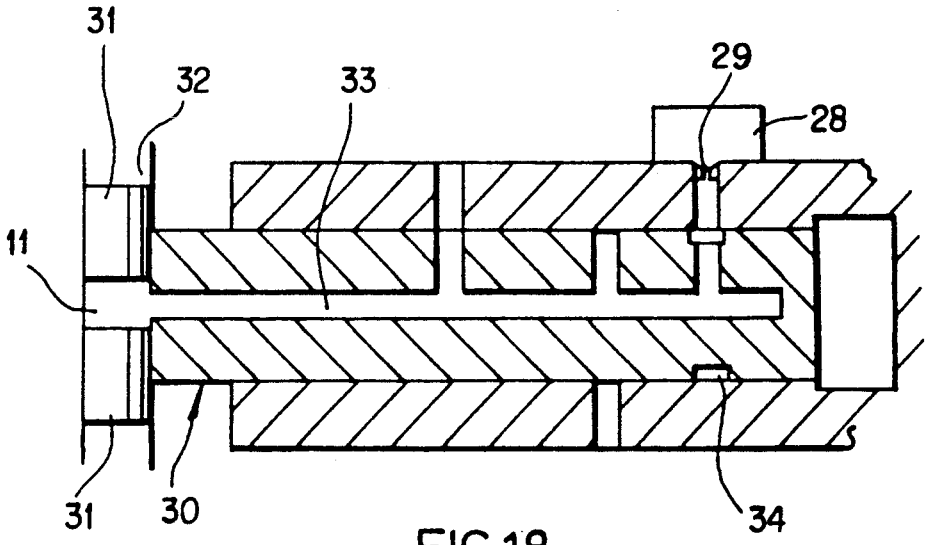
FIG. 18 is similar to FIG. 17 but shows an alternative location for the closed chamber.
Figure 17:
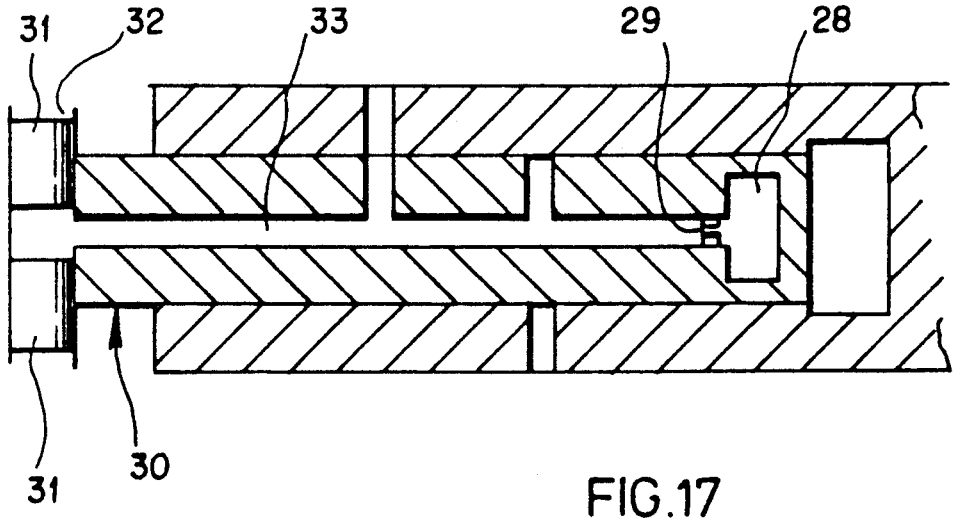
FIG. 17 is a schematic diagram of a rotary distributor type fuel pump incorporating the invention.

The invention is also applicable to rotary distributor type fuel pumps as shown in FIGS. 17 and 18 in which a rotor assembly 30 carries an opposed pair of pistons 31 within an annular cam track 32 so as to produce fuel pulses within the pump working chamber 11 and a central fuel distribution passage 33 as the rotor assembly rotates. The closed chamber 28 may be provided within the rotor assembly so as to communicate through the restriction 29 with the distribution passage 33 as shown in FIG. 17.

Alternatively, the closed chamber 28 may be provided in the pump housing 1 and communicates through the restriction 29 with an annular gallery 34 in the rotor assembly that is connected to the fuel distribution passage 33 as shown in FIG. 18.

Figure 19:
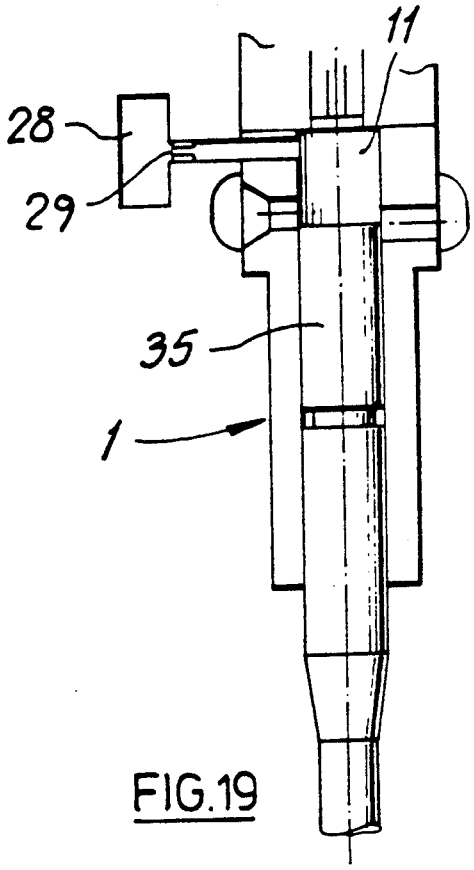
FIG. 19 is a schematic diagram showing the invention applied to an in-line fuel pump.

The invention is also applicable to in-line fuel pumps. As shown in FIG. 19, the pump body 1 of an in-line pump is adapted so that a closed chamber 28 is connected via a restriction 29 to the pump working chamber 11 of each pump piston 35.

Figure 20:
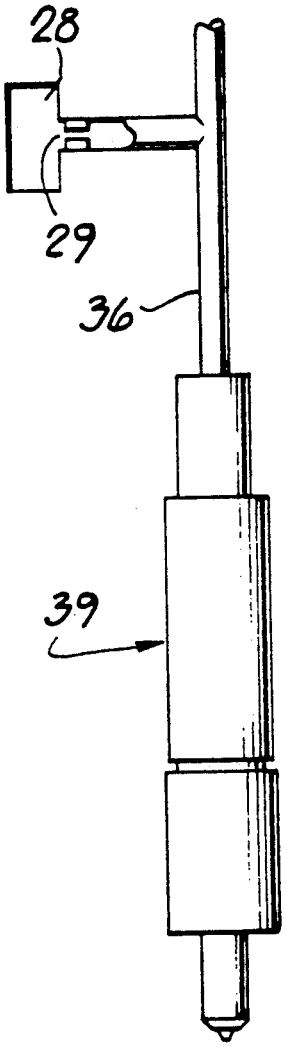
FIG. 20 is a schematic diagram showing an alternative embodiment of the invention with a closed chamber connected in the output pipe to each injector.

In the rotary type fuel pumps illustrated in FIGS. 1, 17 and 18, a single chamber 28 is connected to the pump working chamber 11. However, in alternative embodiments, individual closed chambers 28 may each be connected via a restriction 29 to the high pressure pipe 36 between each pump output 37 and its respective injector 39, as shown in FIG. 20.

Figure 21:
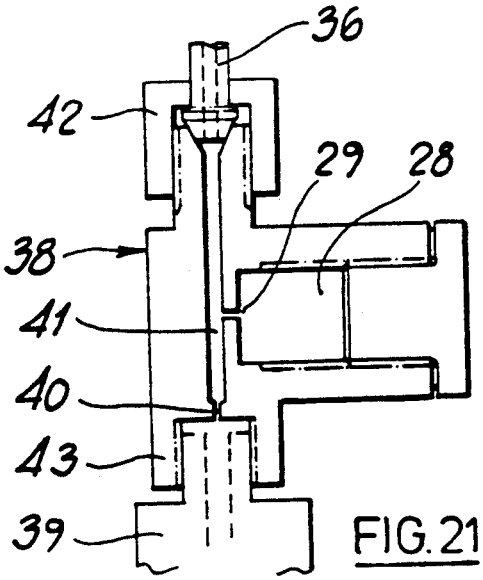
FIG. 21 shows an adaptor incorporating the closed chamber and flow restriction according to the invention for connection to the output pipe to an injector.

The effect of the closed chamber 28 can be enhanced by providing a second flow restriction in the flow path to the fuel injector 39 downstream of the connection to the closed chamber. FIG. 21 illustrates an adaptor 38 that can be connected in the high pressure output connection 36 near the injector and which incorporates the closed chamber 28, the flow restriction 29, and a second flow restriction 40 in a flow passage 41 through the adaptor between an input connector 42 for the pipe 36 and output connector 43 for the injector 39. The second flow restriction 40 is located at the output end of the passage 41 downstream of the restriction 29 that connects the chamber 28 to the passage 41.

Figure 24:
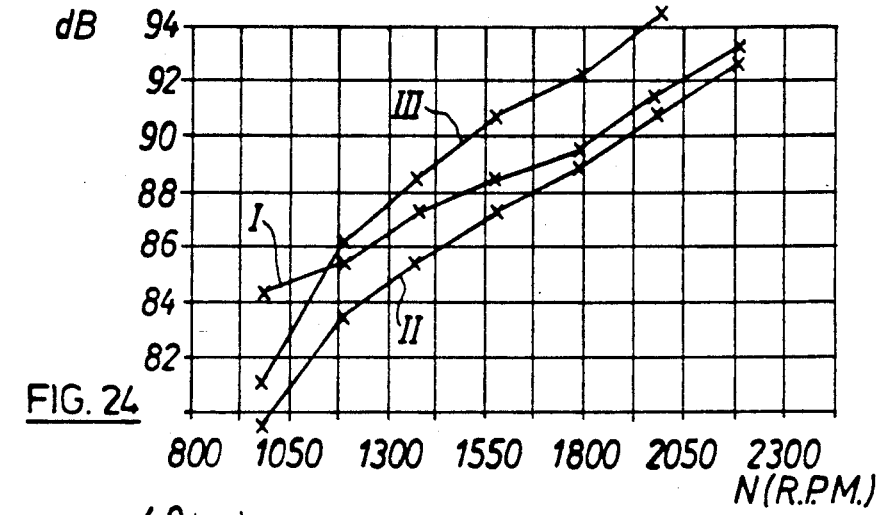
FIG. 24 shows a graph to consumption noise (db) for an engine fitted with the adaptor of FIG. 21.
Figure 23:
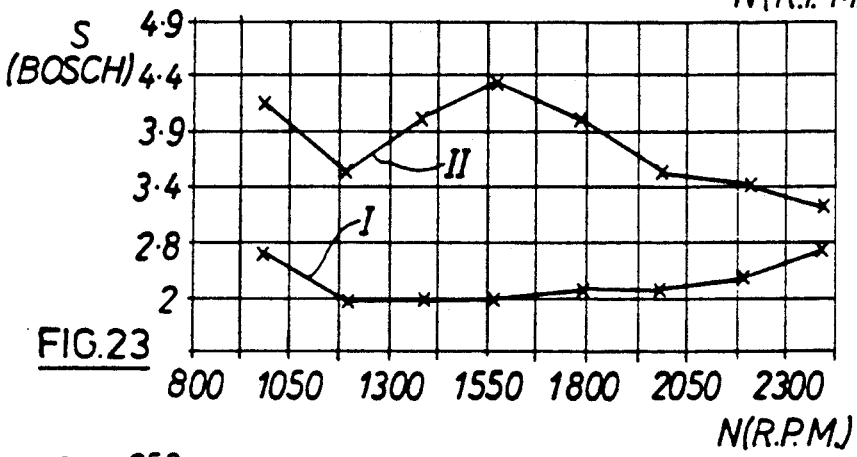
FIG. 23 shows a graph of smoke emissions (S) for an engine fitted with the adaptor of FIG. 21.
Figure 22:
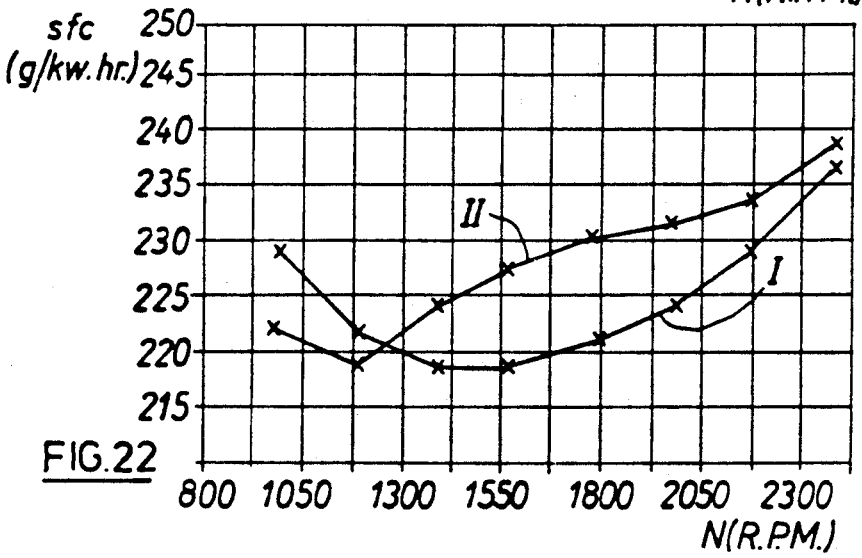
FIG. 22 shows a graph of specific fuel consumption (sfc) for an engine fitted with the adaptor of FIG. 21.

A diesel engine fitted with a conventional pump and injectors and a set of adaptors 38 in the high pressure pipes 36 was subject to a series of engine performance tests measuring specific fuel consumption (sfc), smoke (S) and combustion noise (dB) at different engine speeds at full engine load. The results are shown in FIGS. 22 to 24 compared with similar tests on the same engine, without the adaptors 38 but with a single closed chamber 28 connected directly to the working chamber 11 of the pump, as shown in FIG. 1. The volume of the closed chamber 28 in both tests was 2 c.c., the diameter of the flow restriction 29 was 0.75 m.m., and the diameter of the second flow restriction 40 was 0.65 m.m. compared with an effective diameter of 0.62 m.m. for the total area of the injector nozzle spray holes.

FIG. 22 shows the specific fuel consumption curves and demonstrates that the sfc for the engine with the adaptors 38 shown by curve I, is much improved over most of the middle speed range compared with that without the adaptors and only with the single chamber 28, shown by curve II.

FIG. 23 shows the smoke curves and demonstrates that the smoke for the engine with adaptors 38 shown by curve I, is much improved over all of the speed range, as compared with that without the adaptors and only the single chamber 28 shown by curve II.

FIG. 24 shows the combustion noise curves and demonstrates that the noise for the engine with adaptors 38, shown by curve I, is slightly worse over the middle and lower parts of the speed range, as compared with that without the adaptors and with only the single chamber 28, shown by curve II.

Thus the adaptors 38 give improvements in sfc and smoke with a slight deterioration in combustion noise, but with combustion noise still well below that for the standard engine and fuel pump without the adaptors 38 or closed chamber 28, as shown by curve III in FIG. 24. It is expected that optimisation of the volume of the chamber 28 and the cross-sectional area of the flow restriction 29 and second flow restriction 40 will allow combustion noise to be reduced even further if desired so as to be better than that of curve II for the engine with the closed chamber 28 connected directly to the pump working chamber.

An additional benefit of providing the second flow restriction 40 is that it makes the injection characteristics and engine performance very much more stable, especially at idling speed or under high speed, light load conditions. Instability occurs when small quantities of fuel are being delivered by the pump and small delivery variations have a proportionately greater effect an engine fuelling. Uneven fuelling can then occur which causes the pump governor to reduce the speed, and with the time delays in these responses, the net effect is for the engine to hunt or oscillate about the desired speed. The engine therefore runs irregularly or misfires and the uneven fuelling increases emissions. The effect of the closed chamber 28 is to increase the delivery of the pump by the amount required to fill the chamber so that at idling delivery variations are proportionately smaller and thus the pump less sensitive to these variations.

It will be appreciated that the adaptor 38 illustrated in FIG. 21 can be readily modified by removing the second restriction 40 so that it can be used in the manner illustrated in FIG. 20 to locate the closed chamber near the injector.

Figure 25:
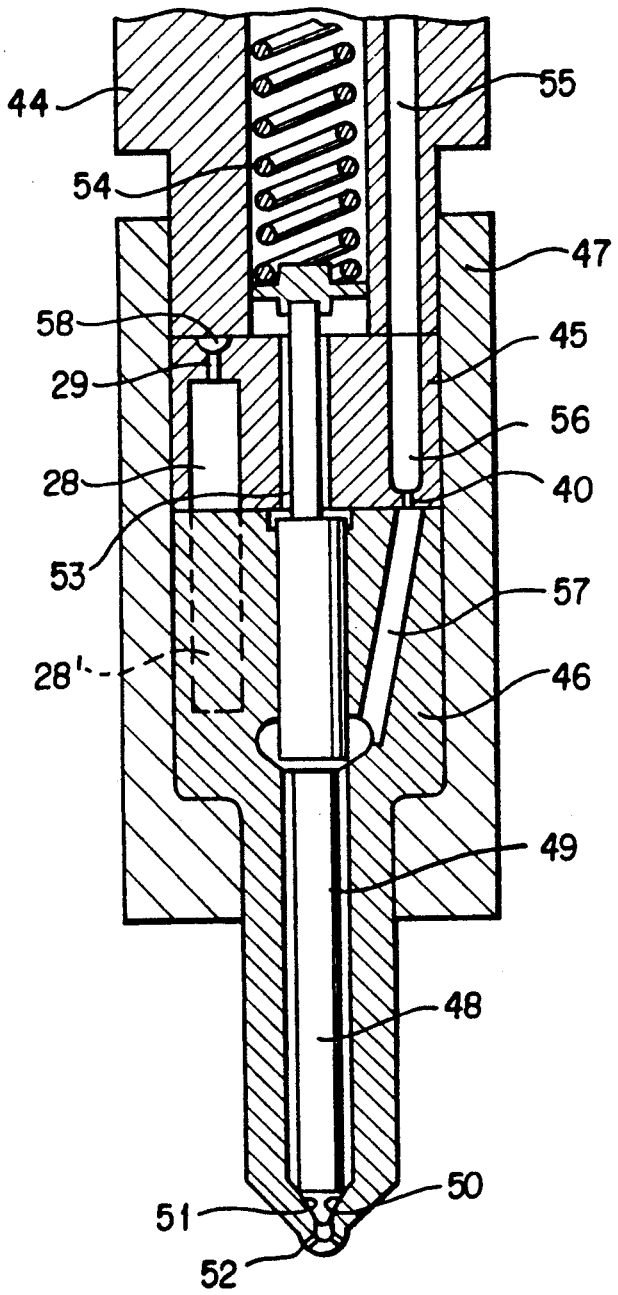
FIG. 25 shows an injector incorporating the closed chamber and flow restriction according to the invention.

Locating the closed chamber 28 near the injector is considered to be beneficial because it helps reduce the adverse effect hydraulic action, especially wave effects, in the fuel flow path between the chamber and injector nozzle spray holes that could otherwise reduce or mask the hydraulic effect of the chamber in modifying the fuel flow to the injector. The addition of the second flow restriction 40 is considered to be beneficial because it enhances the splitting of the fuel flow that occurs at the junction with the flow restriction 40 into the closed chamber 28. Any adverse hydraulic wave effects in the the fuel flow path are reduced by this second flow restriction and only the fuel pulse modified by the closed chamber is transmitted beyond the second flow restriction to the injector. The combined effect of the location of the closed chamber near the injector and the provision of the second flow restriction, as shown in FIG. 21 produces the maximum benefit In another embodiment of the invention, the closed chamber 28 and flow restriction 29 are incorporated in each injector 39, as shown in FIG. 25. Also, the second flow restriction 40 can be incorporated in the injector.

The injector is of generally known construction and comprises a nozzle holder body 44, an intermediate nozzle adaptor 45 and a nozzle 46 assembled coaxially and clamped together by an outer nozzle nut 47.

A needle valve 48 is mounted coaxially within a bore 49 in the nozzle 46 and has a tip 50 that co-operates with a valve seat 51 to control the delivery of fuel from the bore 49 through nozzle spray holes 52 in the tip of the nozzle. The top of the needle 48 extends through a bore 53 in the adaptor 45 and co-operates with a compression spring 54 in the holder body 44 that serves to seat the tip of the needle on the valve seat 51. The adaptor is orientated angularly with respect to the holder body 44 and the nozzle 46 by longitudinal pegs (not shown) so that the nozzle spray holes 52 direct the injected fuel sprays in a predetermined angular orientation relative to the injector body. A fuel supply passage 55 extends longitudinally through the holder body and communicates through a passage 56 in the adaptor 45 with a passage 57 in the nozzle that is connected to the bore 49.

The closed chamber 28 is conveniently formed in the adaptor 45 as a longitudinally extending blind bore closed at one end by the nozzle 46 and with a small hole 29 drilled in its blind end that forms the flow restriction connecting the chamber 28 to the fuel flow path through the injector. As shown in FIG. 25, the upper surface of the adaptor 45 is formed with an arcuate groove 58 that connects the fuel supply passage 55 to the passage 56, and the hole 29 connects the chamber 28 to this groove 58. If the volume of the chamber 28 is such that it cannot all be accomodated in the adaptor 45, then a further blind bore 28′ can be formed in the nozzle 46 in alignment with the blind bore 28.

Where it is required to provide a second flow restriction 40, this can also be conveniently formed in the adaptor 45 by forming the passage 56 as a blind bore and drilling a small diameter hole 40 into the blind end of the bore 56.

Alternatively, if the closed chamber 58 can be formed in the nozzle 46 and connected via a hole 29 directly to the bore 49 then the nozzle spray holes 52 will in effect act as a second restriction and thus this need not be provided as a separate feature.

In yet other embodiments of the invention, instead of providing just one closed chamber for the, or each, pump working chamber or each injector, two or more closed chambers may be provided in place of said one chamber. If these multiple closed chambers are connected to the same part of the system and are to have the same effect as the single closed chamber, then their total volume should be the same as that of the single closed chamber and the total flow area of all the restrictions should equal that of the single closed chamber, with the ratios between the flow areas of the restrictions equal to the ratios between the volumes of the restrictive closed chambers. Each closed chamber then accepts the maximum flow during the ignition delay period at the required design speed.

Instead of connecting these multiple closed chambers to the same part of the system, they may be connected to different parts such as the pump working chamber 11 and a high pressure output connection 36, as shown in FIG. 20, or a respective high pressure input connection 38 of an injector 39, as shown in FIG. 21. If the maximum fuel pressure is different in these different parts of the system, then the respective volumes of the closed chambers and flow areas of the restrictions will need to be correspondingly adjusted.

The invention is also applicable to unit injectors in which each injector also incorporates a fuel pumping element, the closed chamber being connected via a restriction to the pump working chamber of the pumping element in the injector.

It will be appreciated that throughout the description, the restriction of the invention has taken the form of a single aperture 29 opening into the closed chamber 28. However, it is also possible for a single aperture 29 to be replaced by two or more apertures having a total flow area the same as a single aperture. The term "restriction" has therefore to be understood to cover both a single aperture and a plurality of apertures opening into the closed chamber.

I claim:

1. A method of controlling the injection of fuel from a pressurized fuel supply via an injector valve of a fuel injector into a combustion chamber of an internal combustion engine, said method comprising: connecting a closed chamber via a permanently open flow restriction to the pressurized fuel supply, and selecting a volume of the closed chamber to be sufficiently large and a cross-sectional flow area of the restriction to be sufficiently small that, for a given engine fuel delivery volume, a maximum pressure reached in the closed chamber during each engine cycle varies with engine speed, whereby the ratio of fuel flowing into the closed chamber during an entire injection period compared to the total fuel volume delivered to the engine decreases as engine speed increases, thus substantially reducing the flow of fuel into the combustion chamber during an initial period of the injection period at low engine speeds compared to the flow of fuel during said initial period at high engine speeds.

2. Fuel injection equipment for an internal combustion engine comprising:

a fuel injector having an injector valve through which it delivers fuel from a pressurized fuel supply passage, and a closed chamber located on or in the injector and connected to the pressurized fuel supply passage via a permanently open flow restriction, a volume of the closed chamber being sufficiently large and a cross-sectional flow area of the restriction being sufficiently small that, for a given engine fuel delivery volume, a maximum pressure reached in the closed chamber during each engine cycle varies with engine speed, whereby the ratio of fuel flowing into the closed chamber during an entire injection period compared to the total fuel volume delivered to the engine decreases as engine speed increases, thus substantially reducing the flow of fuel into the combustion chamber during an initial period of the injection period at low engine speeds compared to the flow of fuel during said initial period at high engine speeds.

3. Fuel injection equipment for an internal combustion engine comprising: a fuel injection pump adapted to be driven by the engine and having a working chamber with an output to be connected via a fuel supply connection to a fuel injector so that pressure pulses produced periodically in the working chamber at a frequency related to engine speed cause a valve in the injector to open and produce a spray of fuel into a combustion chamber of the engine, and a closed chamber connected via a permanently open flow restriction to the working chamber, a volume of the closed chamber being sufficiently large and a cross-sectional flow area of the restriction being sufficiently small that, for a given engine fuel delivery volume, a maximum pressure reached in the closed chamber during each engine cycle varies with engine speed, whereby the ratio of fuel flowing into the closed chamber during an entire injection period compared to the total fuel volume delivered to the engine decreases as engine speed increases, thus substantially reducing the flow of fuel into the combustion chamber during an initial period of the injection period at low engine speeds compared to the flow of fuel during said initial period at high engine speeds.

4. Fuel injection equipment for an internal combustion engine comprising: a high pressure fuel supply connection adapted to be connected between an output of a fuel injection pump and a fuel injector, said high pressure fuel supply connection having a passage for fluidwise communicating the injection pump and the fuel injector with each other, and a closed chamber connected directly via a permanently open flow restriction to said passage, a volume of the closed chamber being sufficiently large and a cross-sectional flow area of the restriction being sufficiently small that, for a given engine fuel delivery volume, a maximum pressure reached in the closed chamber during each engine cycle varies with engine speed whereby the ratio of fuel flowing into the closed chamber during an entire injection period compared to the total fuel volume delivered to the engine decreases as engine speed increases, thus substantially reducing the flow of fuel into the combustion chamber during an initial period of the injection period at low engine speeds compared to the flow of fuel during said initial period at high engine speeds.

5. A method as claimed in claim 1 in which the closed chamber is connected via the flow restriction (29) to a working chamber in a fuel injection pump driven by the engine and having a high pressure output connection from the working chamber to the fuel injector.

6. A method as claimed in claim 5 in which the fuel injection pump is a rotary type pump with a single working chamber with distribution means to connect said working chamber with each of a plurality of high pressure connections in turn, each being connected to a respective fuel injector.

7. A method as claimed in claim 5 in which the fuel injection pump is an in-line type pump with a plurality of working chambers each connected via a high pressure output connection to a respective fuel injector of the engine, each having a respective closed chamber connected to it via a flow restriction.

8. A method as claimed in claim 1 in which the closed chamber is connected via the flow restriction to a high pressure output connection between a fuel pump and the fuel injector.

9. A method as claimed in claim 8 in which the fuel pump is connected via a plurality of high pressure output connections to each of a plurality of respective fuel injectors of the engine, and a respective closed chamber is connected to each output connection via a flow restriction.

10. A method as claimed in claim 1 in which the fuel injector incorporates a fuel pump element that delivers fuel via the pressurised fuel supply passage to the injector valve.

11. A method as claimed in claim 1 in which the engine is provided with a plurality of injectors each provided with a respective closed chamber and a flow restriction connecting it to a pressurized fuel supply passage within the injector upstream of the injector valve.

12. Fuel injection equipment as claimed in claim 2 in which the fuel injector comprises an elongate body in which the injector valve is located as a longitudinal slide fit and in which the closed chamber is formed as a longitudinally extending chamber.

13. Fuel injection equipment as claimed in claim 2 in which the pressurised fuel supply passage includes a second permanently open flow restriction located downstream of the connection to the closed chamber.

14. Fuel injection equipment as claimed in claim 13 in which the second flow restriction has a cross-sectional flow area no greater than the minimum cross-sectional flow area downstream of the connection to the closed chamber.

15. Fuel injection equipment as claimed in claim 13 or 14 in which the second flow restriction is located adjacent to the flow restriction to the closed chamber.

16. Fuel injection equipment as claimed in claim 2 in which the fuel injector incorporates a fuel pumping element that delivers fuel via said pressurized fuel supply passage to the injector valve.

17. Fuel injection equipment as claimed in claim 3 in which the closed chamber and flow restriction are formed in a component that is removably secured in a wall of the pump surrounding the working chamber.

18. Fuel injection equipment as claimed in claim 3 or 26 in which the pump is a rotary type pump with a single working chamber with distribution means to connect said working chamber with each of a plurality of outputs in turn, each output being connected to a respective fuel injector.

19. Fuel injector equipment claimed in claim 3 or 17 in which the pump is an in-line type pump with a plurality of working chambers each connected via an output to a respective fuel injector of the engine and each having a respective closed chamber connected to it via a flow restriction.

20. Fuel injection equipment as claimed in claim 4 in which the closed chamber and flow restriction are connected to the high pressure fuel supply connection near that end adapted to be connected to the fuel injector.

21. Fuel injection equipment as claimed in claim 3 or 20 in which the high pressure fuel supply connection includes a second permanently open flow restriction which is located downstream of the connection from the closed chamber.

22. Fuel injection equipment as claimed in claim 21 in which the cross-sectional flow area of the second flow restriction is no greater than the minimum cross-sectional flow area downstream of it in the connection or injector.

23. Fuel injection equipment as claimed in claim 3 or 20 in which the closed chamber and flow restriction are formed in a component that is connected to the high pressure fuel supply connection.

24. Fuel injection equipment as claimed in claim 21 in which the closed chamber and both flow restrictions are formed in a component (38) that is connected to the high pressure fuel supply connection.

25. Fuel injection equipment as claimed in claim 3 in which said predetermined engine speed is selected for the reduction of engine combustion noise up to this speed.

26. An internal combustion engine fitted with fuel injection equipment as claimed in claim 2.

27. A method as claimed in claim 1 comprising connecting a second permanently open flow restriction in the pressurised fuel supply downstream of the connection to the closed chamber.

28. A method as claimed in claim 1 comprising locating the closed chamber on or within the fuel injector and connecting the closed chamber to a pressurised fuel supply passage via the flow restriction located upstream of the injector valve.

29. A method as claimed in claim 1, further comprising: selecting the volume of the closed chamber and the cross-sectional flow area of the restriction so that at engine speeds up to a predetermined engine speed, the maximum pressure reached in the closed chamber corresponds to the maximum compressibility of the fuel in the closed chamber.

30. A method as claimed in claim 29, further comprising: selecting the predetermined engine speed for the reduction of engine combustion noise up to said predetermined engine speed.

31. Fuel injection equipment as claimed in claim 2, wherein the volume of the closed chamber and the cross-sectional flow area of the restriction are selected so that at engine speeds up to a predetermined engine speed, the maximum pressure reached in the closed chamber corresponds to the maximum compressibility of the fuel in the closed chamber.

32. Fuel injection equipment as claimed in claim 31, wherein the predetermined engine speed is selected so that engine combustion noise is reduces up to said predetermined speed.

33. Fuel injection equipment as claimed in claim 12, wherein the elongate body comprises a main body component, a nozzle component, and an intermediate component located therebetween, the closed chamber being formed in the intermediate component.

34. Fuel injection equipment as claimed in claim 33, wherein the closed chamber is formed by aligned bores in the intermediate component and the nozzle component of the elongate body.

35. Fuel injection equipment as claimed in claim 12, wherein the elongate body comprises a main body component, a nozzle component, and an intermediate component located therebetween, the flow restriction being formed in the intermediate component in alignment with the longitudinally extending closed chamber.

36. Fuel injection equipment as claimed in claim 13, wherein the elongate body comprises a main body component, a nozzle component, and an intermediate component located therebetween, both flow restrictions being formed in the intermediate component so that one flow restriction communicates with the closed chamber on one side of the intermediate component and the pressurized fuel supply passage on the other side of the intermediate component, and the second flow restriction is connected in line with the pressurized fuel supply passage.

37. Fuel injection equipment as claimed in claim 3, wherein the volume of the closed chamber and the cross-sectional flow area of the restriction are selected so that at engine speeds up to a predetermined engine speed, the maximum pressure reached in the closed chamber corresponds to the maximum compressibility of the fuel in the closed chamber.

* * * * *